US005638885A

United States Patent [19]

Freese et al.

[11] Patent Number: 5,638,885

[45] Date of Patent: Jun. 17, 1997

[54] QUICK RELEASE SOFT GATE

[75] Inventors: Theodore B. Freese, Westminster; Blair S. Barnes, Denver; Maria D. Young, Boulder, all of Colo.

[73] Assignee: Gerry Baby Products Company, Thornton, Colo.

[21] Appl. No.: 554,847

[22] Filed: Nov. 7, 1995

[51] Int. Cl.[6] ..... E06B 3/30

[52] U.S. Cl. ..... 160/371; 160/225; 160/369; 160/375; 403/321; 49/55; 49/465

[58] Field of Search ..... 160/369, 371, 160/375, 224, 225; 49/50, 55, 463, 465; 403/321, 322, 325, 329

[56] References Cited

U.S. PATENT DOCUMENTS

| | | | |
|---|---|---|---|
| 646,120 | 3/1900 | Gallaher . | |
| 975,470 | 11/1910 | Shrady | 160/377 |
| 1,450,920 | 4/1923 | Hutchinson . | |
| 1,532,769 | 4/1925 | McElroy . | |
| 2,225,963 | 12/1940 | Augustine | 160/373 X |
| 2,357,819 | 9/1944 | Greer | 160/377 X |
| 3,000,063 | 9/1961 | Hoog | 49/55 X |
| 4,431,331 | 2/1984 | Brody | 403/329 X |
| 4,492,263 | 1/1985 | Gebhard | 160/228 |
| 4,944,117 | 7/1990 | Gebhard et al. | 49/55 |
| 5,272,840 | 12/1993 | Knoedler et al. | 49/463 |
| 5,293,656 | 3/1994 | Chan | 403/102 X |
| 5,437,115 | 8/1995 | Freese et al. | 49/465 |
| 5,531,258 | 7/1996 | Poulson et al. | 160/371 X |

*Primary Examiner*—Blair Johnson
*Assistant Examiner*—Bruce A. Lev
*Attorney, Agent, or Firm*—Robert G. Crouch; Chrisman, Bynum & Johnson

[57] ABSTRACT

A security gate for positioning within an area way such as a doorway. The gate includes a support structure defined by a frame and a flexible panel supported by the frame. The frame includes horizontal members and vertical members detachable engaged with the horizontal members. One end of the horizontal members includes a lock assembly including a pivoting linkage defining a parallelogram structure for facilitating firm engagement of the horizontal members with opposing sides of the doorway.

18 Claims, 3 Drawing Sheets

QUICK RELEASE SOFT GATE

BACKGROUND OF THE INVENTION

The present invention relates to a closure device for placement in a doorway and, more particularly, to a security gate which may be frictionally engaged with a doorway for preventing infants or small children from passing through the doorway, and which may be easily and quickly released from the doorway.

In environments where small children or infants are present, it is generally desirable to have a closure device or security gate which may be removably placed within an area way, such as a doorway, to prevent passage therethrough. For example, it may be desirable to restrict small children to a particular room without shutting the door to the room such that one can look into the room or the children can see an adult nearby.

Various means and techniques have been devised for the formation of barriers or closures across area ways wherein the gate may be removably mounted within the area way and which typically include means for adjusting the width of the gate to accommodate different distances between the side portions of the area way. For example, U.S. Pat. No. 4,492,262 to Gebhardt discloses an infant security door gate assembly which includes upper and lower support bars incorporating coil springs positioned within telescoping tubes to form a compression friction fit within the doorway. In addition, the gate of Gebhardt is formed of a pair of complementary overlapping panels.

U.S. Pat. No. 4,944,117 to Gebhardt et al. and U.S. Pat. No. 5,272,840 to Knoedler et al. disclose security gate constructions which include overlapping substantially rigid panels which may be adjusted relative to each other to provide for a width adjustment.

While the above-described gates are satisfactory for preventing passage of an infant or small child through a doorway, there is a need for a security gate which is adapted to be easily mounted within a doorway, and which is additionally capable of being quickly released from the doorway.

SUMMARY OF THE INVENTION

In accordance with the present invention, a security gate is provided which forms a releasable closure adapted for disposition between spaced, confronting sides of an area way, such as a doorway, and which may be easily removed from the doorway and conveniently folded to a compact form.

In one aspect, the present invention provides a releasable closure for disposition between spaced confronting sides of an area way and including first and second horizontal members for extending between the sides of the area way. A pair of vertical members are provided extending between the horizontal members such that the horizontal and vertical members define a frame for the closure. A panel is supported within the frame defined by the horizontal and vertical members, and the panel is preferably formed of a flaccid material, such as a fabric.

First and second lock assemblies are attached to first ends of the first and second horizontal members, respectively. Each of the lock assemblies includes a body portion mounted to a respective first end, and a thrust member pivotally connected to the body portion. The thrust member is connected to the body portion by means of first and second link members which are pivotally mounted to the body portion and to the thrust member. The link members are substantially parallel to each other and define a parallelogram structure in combination with the body portion and thrust member. Movement of the thrust member toward the body portion causes the thrust member to move in a horizontal direction away from the first end.

Thus, the closure of the present invention may be mounted in an area way by engaging second ends of the horizontal members, opposite from the first ends, with one side of the doorway and engaging an end of the thrust members with the opposing side of the area way. Pushing down on the first ends of the horizontal members causes the link members to move to an over center position within the body portion of the lock assembly while also moving the thrust members outwardly to thereby form a positive friction fit within the area way.

In addition, the horizontal members comprise telescoping tubes which are spring biased away from each other. The springs within the horizontal members provide a biasing force to ensure that the horizontal members are firmly held in place within the area way.

The vertical members include tube rings located at each end thereof for engaging the horizontal members. The tube rings may be detached from the horizontal members to permit the gate to be folded for storage or transport.

Therefore, it is an object of the present invention to provide a security gate which may be firmly mounted within an area way, and which may be easily released for removal from the area way.

It is a further object of the invention to provide a security gate which may be partially disassembled and folded when not in use.

Other objects and advantages of the invention will be apparent from the following description, the accompanying drawings and the appended claims.

DETAILED DESCRIPTION OF THE PREFERRED EMBODIMENT

Figure 1:
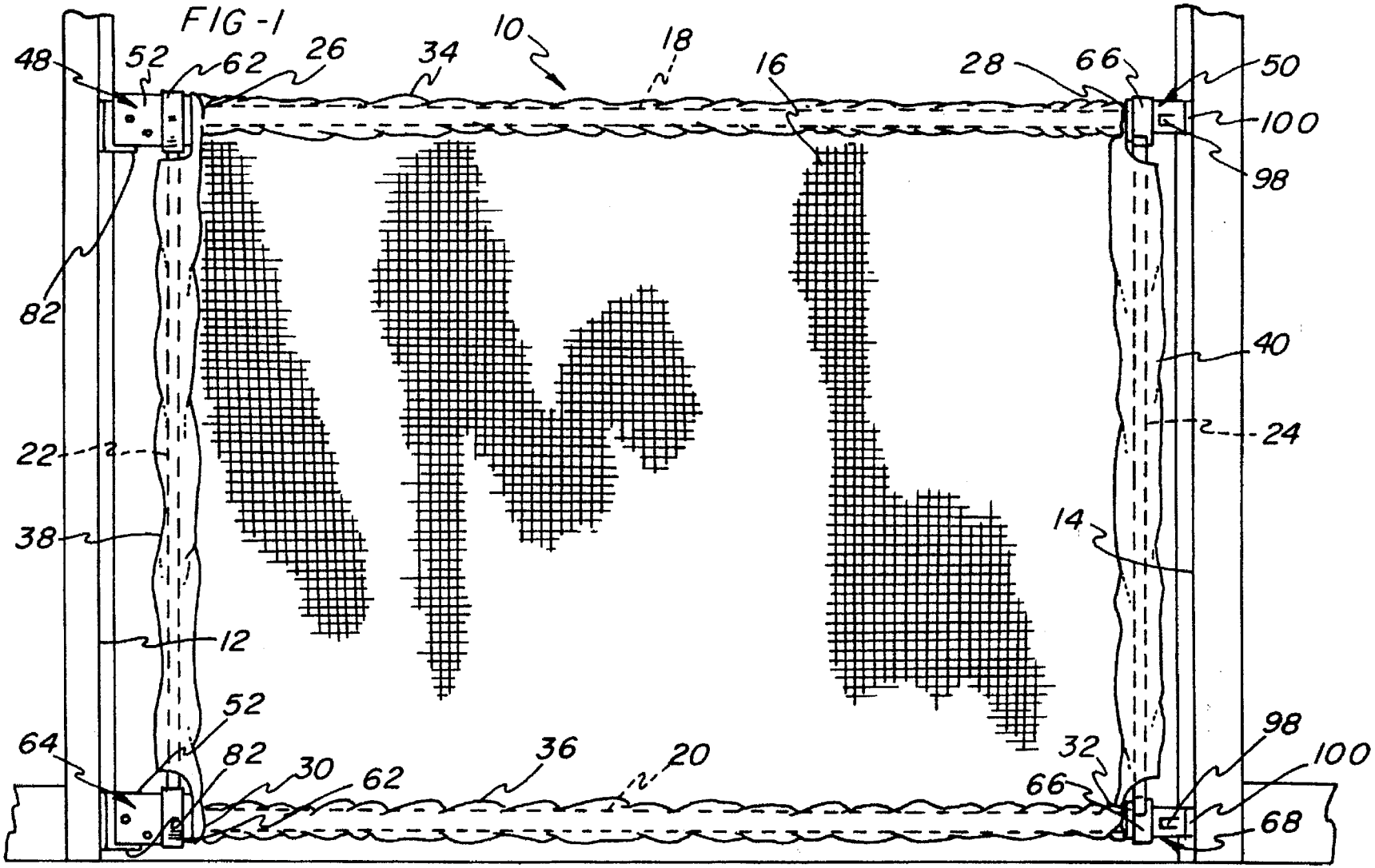
FIG. 1 is a front elevational view of the security gate for the present invention located between opposed confronting vertical surfaces of a doorway.

Referring to FIG. 1, the security gate 10 of the present invention is shown extending across an area way, such as a doorway, including spaced, confronting sides 12, 14. The security gate 10 includes a central panel portion 16 formed of a flexible flaccid material, such as a fabric, supported by a frame defined by first and second horizontal members 18, 20 and first and second vertical members 22, 24. The first horizontal member 18 forms an upper support and includes a first end 26 and a second end 28. Similarly, the second horizontal member 20 defines a lower support member having a first end 30 and a second end 32. The vertical member 22 is connected to the horizontal members 18, 20 at the first ends 26, 30, and the second vertical member 24 is connected to the horizontal members 18, 20 at the second ends 28, 32. It should be noted that upper and lower portions 34, 36 of the panel 16 define tubular material portions through which the horizontal members 18, 20 pass, and the side portions 38, 40 of the panel 16 similarly define tubular material portions for receiving the vertical members 22, 24 therethrough.

Figure 2:
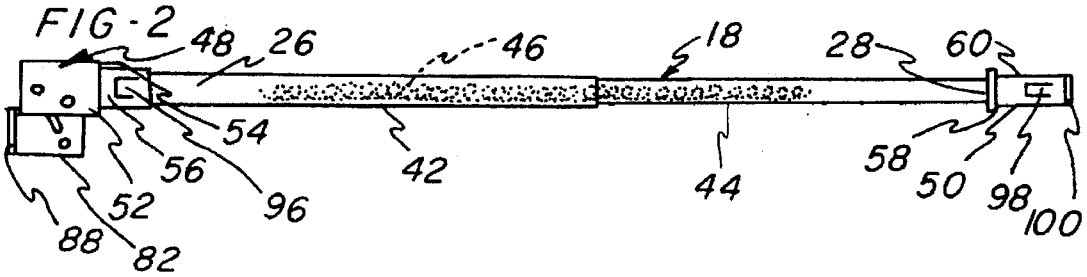
FIG. 2 is an elevational view of one of the horizontal members for the gate.

Referring to FIG. 2, the first or upper horizontal member 18 is shown, it being understood that the second horizontal member 20 is provided with an identical construction. The horizontal member 18 is formed of a pair of tubes 42, 44 located in telescoping relationship to each other and biased outwardly from each other by a compression spring 46 in a conventional manner known in the art. A lock assembly 48 is attached to the first end 26 of the horizontal member 18, and an end cap 50 is attached to the second end 28. The lock assembly 48 includes a body portion 52 having a shoulder 54 defining a shoulder area 56. Similarly, the end cap 50 includes a flange defining a shoulder 58 adjacent to a shoulder area 60.

Referring further to FIG. 1, the first vertical member 22 includes identical tube rings 62 at opposing ends thereof wherein one of the tube tings 62 is located in the shoulder area 56 of the lock assembly 52, and the other tube ting 62 is engaged with a similar shoulder area on a lower lock assembly 64 of the horizontal member 20. The second vertical member 24 also includes tube tings 66 at opposing ends thereof wherein one of the tube tings 66 engages the shoulder area 60 of the end cap 50, and the other tube ring 66 engages a similar shoulder area on the lower end cap 68.

Figure 3:
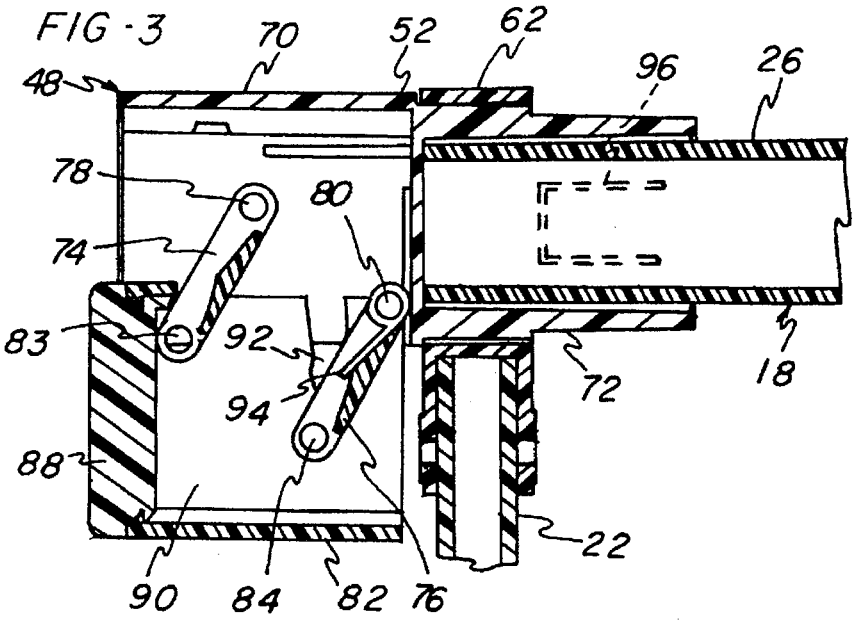
FIG. 3 is a cross sectional view of one of the lock assemblies in a released position.
Figure 4:
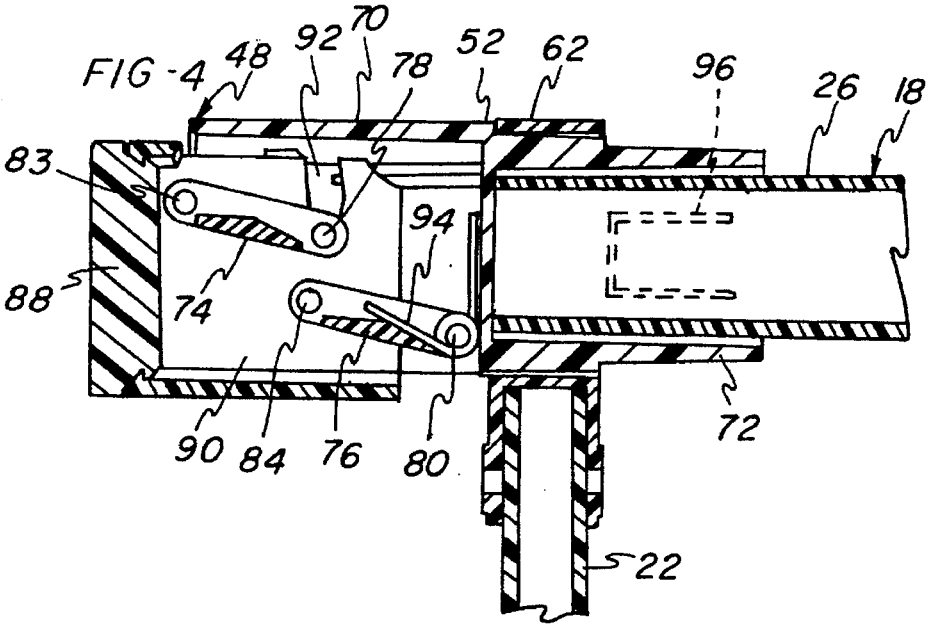
FIG. 4 is a cross sectional view of one of the lock assemblies in a locked position.
Figure 5:
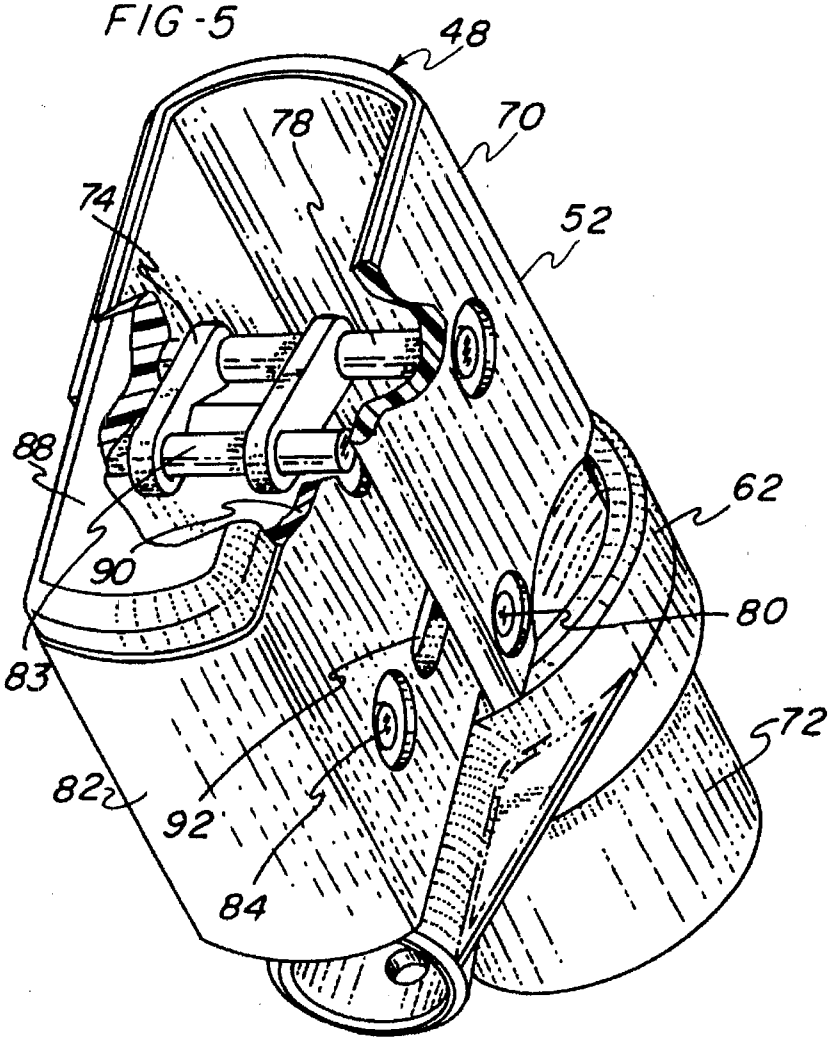
FIG. 5 is a partially cut away perspective view of an engagement end of one of the lock assemblies.

Referring to FIGS. 3–5, the lock assembly 48 is illustrated wherein the body portion 52 includes a substantially U-shaped forward portion 70 and a tubular mounting portion 72 for attachment to the second end 26 of the respective horizontal member 18. First and second pivot links 74, 76 are pivotally mounted within the forward portion 70 by respective pivot pins 78, 80.

A thrust body 82 is formed as a U-shaped member connected to the body portion 48 by the link members 74, 76 at pivot pins 83, 84. The link members 74, 76 extend substantially parallel to each other such that the link members 74, 76, body portion 52 and thrust member 82 define a parallelogram structure for guiding movement of the thrust member 82 relative to the body portion 52. Thus, as the thrust member 82 moves from a position displaced downwardly from the body portion 52, as illustrated in FIG. 3, to the position shown in FIG. 4 wherein the thrust member 82 is positioned upwardly into close association with the body portion 52, it moves in a direction away from the first end 26 of the horizontal member 18. In this manner, the thrust member 82 moves into pressing engagement with the side of the area way 12 as, for example, the first end 26 is pressed downwardly with a contact pad 88 of the thrust member 82 in engagement with the side 12.

It should be noted that as the relative position between the thrust member 82 and body portion 52 moves from that shown in FIG. 3 to the position shown in FIG. 4, the link members 74, 76 are moved to an over center position such that the thrust member 82 will tend to remain in the locked position shown in FIG. 4. Further, the spring 46 within the horizontal member 18 provides a resilient biasing force for maintaining the lock assembly 48 in a locked position.

It may also be noted that the first link 74 is located above the second link 76, and the pivot 80 for the second link 76 is located closer to the first end 26 then the pivot 78 for the first link 74. This construction provides for a stable linkage when the lock assembly 48 is in a locked position. Further, side walls 90 of the thrust member 82 are provided with curved slots 92 which are adapted to receive the first link member pivot pin 78 therein as the thrust member 82 moves to a locked position and which may define a stop position upon engagement of an end wall of the slot 92 with the pin 78. Further, a torsion spring 94 may be provided engaged with one of the links 76 for providing a biasing force to move the thrust member 82 to a downward location when it is not positioned for locking the gate 10 in an area way.

Figure 6:
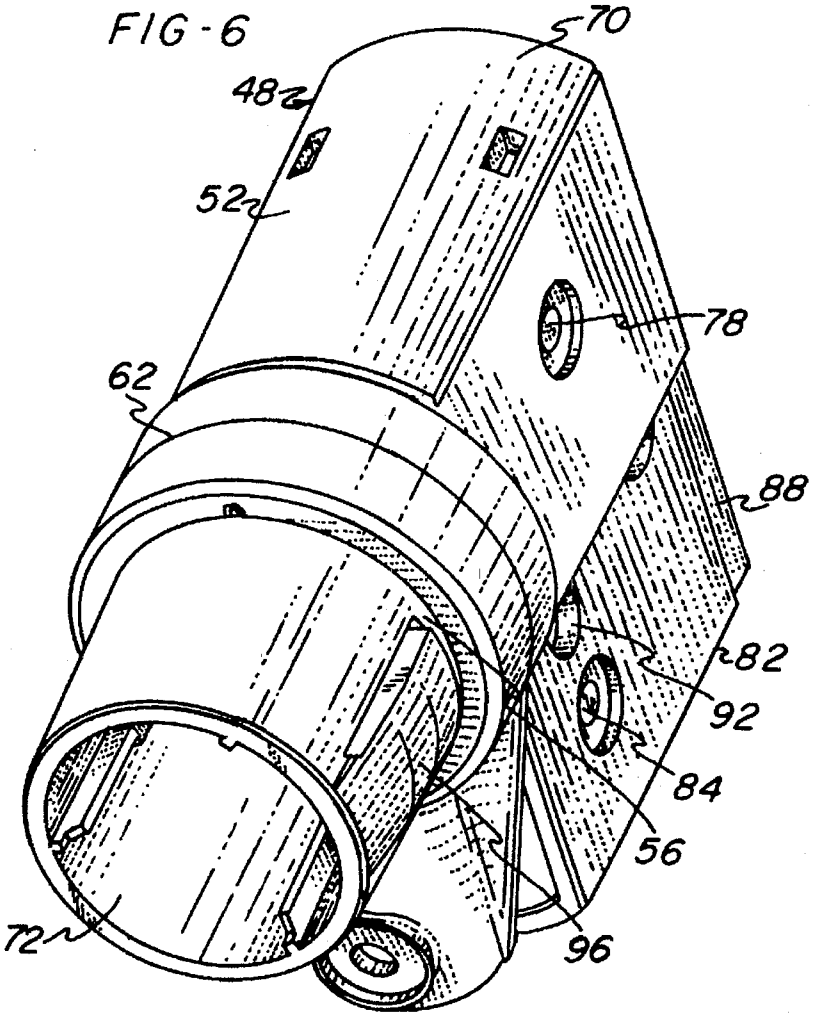
FIG. 6 is a perspective view illustrating the connection of one of the tube rings and a lock assembly.

Referring further to FIG. 6, the tubular portion 72 of the body portion 52 includes a latching tongue 96 which is positioned to latch and maintain the tube ring 62 in position on the shoulder area 56. The end caps 50, 68 include a similar tongue 98 for latching the tube rings 66 in position. It should be noted that the locking assemblies 48, 64 and end caps 50, 68 are preferably formed of a plastic material and that the latching tongues 96 and 98 are preferably formed integrally with the locking assemblies 48, 64 and end caps 50, 68, respectively. Further, the tube tings 62, 66 and respective latching tongues 96, 98 operate in a manner similar to that disclosed for the latching mechanism of the gate disclosed in U.S. patent application Ser. No. 08/276,948, assigned to the assignee of the present invention, and incorporated herein by reference.

In use, the present gate 10 may be assembled for use and disassembled for transportation or storage. Specifically, the horizontal members 18, 20, in a disassembled configuration, are removed from association with the tube rings 62, 66 and are separated from the upper portion 34 and lower portion 36 of the panel 16. Thus, the vertical members 22, 24 maybe brought together and the panel 16 folded to form a compact configuration for the gate 10.

In assembling the gate 10, it should be noted that the tube rings 62 include a circular portion which defines an inner circumference larger than an inner circumference defined by a circular portion of the tube rings 66. The circumference of the tube rings 62 is such that the end caps 50, 68 may be passed through the tube tings 62, through the upper and lower portions 34, 36 and through the tube tings 66 until the shoulders 58 engage with the tube tings 66. As the horizontal members 18, 20 are passed through the upper and lower portions 34, 36, the shoulder area 56 is brought into engagement with the tube rings 62, and the tube tings 62 are of such a circumference that they will engage the shoulders 54 of the respective locking assemblies 48, 64 and be maintained in position by the latching tongues 96. Disassembly of the gate 10 may be accomplished by reversing the assembly procedure including depressing the latching tongues 96, 98 to release the tube rings 62, 66 from engagement with the ends of the horizontal members 18, 20.

In positioning the gate 10 within an area way, the horizontal members 18, 20 are initially adjusted by rotating the tubes 42, 44 relative to each other to thereby adjust the overall length of the horizontal members 18, 20 in a conventional manner known in the art whereby the contact pads 88 of the locking assemblies 48, 64 define an engagement portion which is brought into engagement with the side wall 12, and contact pads 100 on the end caps 50, 68 are brought into engagement with the wall 14. The first ends 26, 30 of the horizontal members 18, 20 are then pushed downwardly causing relative movement between the thrust members 82 and body portions 52 of the lock assemblies 48, 64 whereby the thrust members 82 move upwardly into the body portions 52 while moving horizontally away from the first ends 26, 30 of the horizontal members 18, 20. During this movement, the springs 46 within the horizontal members 18, 20 compress to provide a firm engagement force for maintaining the link members 74, 76 in their over center locked position to thereby maintain the gate in position between the sides 12, 14.

When it is desired to release the gate, the first ends 26, 30 of the horizontal members 18, 20 are lifted to quickly release the horizontal members 18, 20 from engagement with the sides 12, 14 of the area way. In this manner, an easily positioned gate is provided which may be quickly released from a doorway and which also provides for a compact configuration when it is desired to store or transport the gate.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A releasable closure adaptable for disposition between spaced, confronting sides of an area way, said releasable closure comprising:

first and second horizontal members for extending between the sides of said area way, said horizontal members each including a first end and a second end;

first and second vertical members extending between said first and second horizontal members;

a panel supported between said horizontal members and said vertical members;

first and second lock assemblies attached to said first ends of said first and second horizontal members, respectively;

said first lock assembly including a first body portion mounted to said first end of said first horizontal member, a first link member supported on said first body portion and a second link member supported on said first body portion below said first link member wherein said first and second link members are pivotally mounted to said first body portion, said first lock assembly further including a first thrust member located below said first body portion and pivotally mounted to said first and second link members, said firs thrust member including an engagement surface for engaging a side of said area way;

said second lock assembly including a second body portion mounted to said first end of said second horizontal member, a first link member supported on said second body portion and a second link member supported on said second body portion below said first link member wherein said first and second link members are pivotally mounted to said second body portion, said second lock assembly further including a second thrust member located below said second body portion and pivotally mounted to said first and second link members, said second thrust member including an engagement surface for engaging a side of said area way; and wherein said first and second link members of each of said first and second lock assemblies are substantially parallel to each other and define, in combination with said first and second body portions and said first and second thrust members, respectively, independently movable first and second parallelogram structures such that movement of said first and second thrust members toward said first and second body portions, respectively, causes said thrust members to move in a horizontal direction away from said first ends of said first and second horizontal members, respectively.

2. The closure as recited in claim 1 wherein said first link member is located above said second link member, and a pivot connection between said second link member and said body portion is closer to said respective first end than a pivot connection between said first link member and said body portion.

3. The closure as recited in claim 1 wherein said horizontal members comprise telescoping tubes.

4. The closure as recited in claim 3 wherein said telescoping tubes are spring biased outwardly away from each other whereby said first and second ends of said horizontal members are biased toward said spaced sides of said area.

5. The closure as recited in claim 1 wherein said body portion includes a shoulder area and each said vertical member includes opposing ends and a tube ting attached to each of said ends, each said tube ring including a circular portion positioned in engagement with a respective shoulder area.

6. The closure as recited in claim 5 wherein said circular portions of said tube rings on said first vertical member define a larger inner circumference than an inner circumference of said circular portions of said tube tings on said second vertical member.

7. The closure as recited in claim 5 wherein said horizontal members are slidably received through said circular portions of said tube rings.

8. The closure as recited in claim 1 wherein said panel comprises a flexible fabric panel.

9. The closure as recited in claim 1 including a spring acting on said thrust member to bias said thrust member away from said body portion.

10. A releasable closure adaptable for disposition between spaced, confronting sides of an area way, said releasable closure comprising:

first and second horizontal members for extending between the sides of said area way, said horizontal members each comprising telescoping tubes including a first end and a second end wherein said first and second ends of said horizontal members are spring biased outwardly away from each other;

first and second vertical members extending between said first and second horizontal members;

a panel supported between said horizontal members and said vertical members;

a locking structure attached to said first ends of said first and second horizontal members, said locking structure including an engagement portion for engaging a side of said area way and a parallelogram linkage supporting said engagement portion; and wherein engaging said engagement portion and said second ends of said horizontal members with the sides of said area way and applying downward pressure at said first ends of said first and second horizontal members results in said parallelogram linkage and said engagement portion moving upwardly and outwardly relative to said first ends, and causes said telescoping tubes to compress together to thereby provide a biasing force for maintaining said horizontal members in position within said area way.

11. The closure as recited in claim 10 wherein said locking structure comprises first and second lock assemblies attached to said first ends of said first and second horizontal members, respectively.

12. The closure as recited in claim 11 wherein each said lock assembly includes a body portion mounted to a respective first end, first and second link members pivotally mounted to said body portion and a thrust member located below said body portion and pivotally mounted to said first and second link members, said thrust member including an engagement surface defining said engagement portion for engaging a side of said area way.

13. The closure as recited in claim 12 wherein said first and second link members are substantially parallel to each other and define a parallelogram structure in combination with said body portion and said thrust member such that movement of said thrust member toward said body portion causes said thrust member to move in a horizontal direction away from said respective first end.

14. The closure as recited in claim 13 including a spring acting on said thrust member to bias said thrust member away from said body portion.

15. The closure as recited in claim 10 wherein each said vertical member includes opposing ends and a tube ring attached to each of said ends, each said tube ring including a circular portion for receiving one of said horizontal members therethrough.

16. The closure as recited in claim 15 wherein said circular portions of said tube rings on said first vertical member define a larger inner circumference than an inner circumference of said circular portions of said tube tings on said second vertical member.

17. The closure as recited in claim 10 wherein said panel comprises a flexible fabric panel.

18. A releasable closure adaptable for disposition between spaced, confronting sides of an area way, said releasable closure comprising:

first and second horizontal members for extending between the sides of said area way, said horizontal members each including a first end and a second end;

first and second vertical members extending between said first and second horizontal members;

a panel supported between said horizontal members and said vertical members;

first and second lock assemblies attached to said first ends of said first and second horizontal members, respectively;

each said lock assembly including a body portion mounted to a respective first end, a first link member pivotally mounted to said body portion at a first pivot connection, a second link member located below said first link member and pivotally mounted to said body portion at a second pivot connection closer to said respective first end than said first pivot connection, and a thrust member located below said body portion and pivotally mounted to said first and second link members, said thrust member including an engagement surface for engaging a side of said area way; and wherein said first and second link members are substantially parallel to each other and define a parallelogram structure in combination with said body portion and said thrust member such that movement of said thrust member toward said body portion causes said thrust member to move in a horizontal direction away from said respective first end.

* * * * *